United States Patent [19]

Borovina et al.

[11] 4,308,990

[45] Jan. 5, 1982

[54] FLUE GAS HEAT RECOVERY SYSTEM

[76] Inventors: Anton Borovina, 67 N. Columbia St., Port Jefferson Station, N.Y. 11776; Henry E. Grattan, Box 531 Strongs Neck, Setauket, Long Island, N.Y. 11733; Mark Borovina, 67 N. Columbia St., Port Jefferson Station, N.Y. 11776

[21] Appl. No.: 112,869

[22] Filed: Jan. 17, 1980

[51] Int. Cl.[3] ..... F24F 11/04; F28F 27/00

[52] U.S. Cl. ..... 236/10; 237/55; 165/DIG. 2; 165/76; 165/95; 165/121; 236/38; 126/110 R

[58] Field of Search ..... 237/55; 165/DIG. 2, 165/39, 121, 76, 95; 122/20 B; 126/110 R; 236/9 R, 10, 38

[56] References Cited

U.S. PATENT DOCUMENTS

| | | | |
|---|---|---|---|
| 1,573,406 | 2/1926 | Lewis | 237/55 |
| 3,934,798 | 1/1976 | Goldsmith | 165/DIG. 2 |
| 4,103,735 | 8/1978 | Warner | 237/55 |
| 4,147,303 | 4/1979 | Talucci | 237/55 |

*Primary Examiner*—Albert J. Makay
*Assistant Examiner*—Henry Bennett
*Attorney, Agent, or Firm*—Shoemaker and Mattare, Ltd.

[57] ABSTRACT

A flue gas heat recovery system includes a heat exchanger fluidly interposed between a furnace and a chimney to receive hot flue gas from the furnace. The heat exchanger is releasably mounted in the chimney and includes a partition which forces air being heated by the heat exchanger to traverse a path through the heat exchanger which maximizes the time of contact between that air and the heat exchanger heating elements. The partition further creates turbulence in the heat air.

8 Claims, 4 Drawing Figures

DAMPERS
THERMOSTAT
FAN
CM
CW
CU
CAF
HAF
CA
HA
OIL BURNER
+120V
66
75
74
130
128
88
230
232
240
70
71
126
76
52
206
132
134
90
224
226
220
120
100
222
242
60
210
62
200
136
92
138
94
12
96
98
86
14
72
82
124
122
75
80
84
20
64
G
202

FLUE GAS HEAT RECOVERY SYSTEM

BACKGROUND OF THE INVENTION

The present invention relates in general to heat exchangers, and, more particularly, to heat exchangers for use in recovering flue heat from a furnace.

In recent years it has become increasingly important to find efficient ways of heating buildings. This problem affects not only home owners, but all those who are involved in heating homes, such as renters, apartment owners and the like. Furthermore, even businesses are faced with this problem. In fact, anyone who must heat any type of building is constantly searching for ways of increasing the efficiency of the heating unit or systems used.

The problem of maximizing the efficiency of heating systems has engendered many devices. Examples of such devices are disclosed in U.S. Pat. Nos. 4,147,303, 2,032,553, 4,103,735, 4,044,950, 3,944,136, 2,764,391, 2,362,940, 2,343,542, 3,124,197, 3,813,039, 3,934,798 and 4,050,628.

However, these devices suffer several drawbacks. Firstly, the devices, once installed, are difficult to remove for servicing, cleaning or replacement of a heat exchanger unit. Secondly, the heat exchangers do not mix the air being heated as well as such air could be mixed, and do not expose that air to heat exchanger heating elements as long as possible. Longer exposure to heating elements and good mixing of the air exposed to those heating elements will increase the amount of heat transferred to that air by those heating elements as that air passes through the heat exchanger.

SUMMARY OF THE INVENTION

The device embodying the teachings of the present invention includes means for releasably mounting a heat exchanger in a wall so that heat exchanger can be readily removed for cleaning, servicing, replacement or the like. Furthermore, the heat exchanger of the presently disclosed device includes means for agitating the air within the heat exchanger and for causing that air to be exposed to the heat transferring surfaces for a time interval which is increased over known heat exchangers.

The device includes a heat exchanger fluidly interposed between a furnace flue and a chimney so that hot flue gases are used as a heating medium within that heat exchanger. Cold air returning from a room, or rooms, in a building is forced into the heat exchanger and is heated therein. This heated air is forced back into the heating system and is directed to various areas of the building heated by this system. A suitable control system is associated with the heat exchanger and reheating system to direct heated air to desired areas, and to control operation of the system.

The device includes a sleeve installed in a chimney which accommodates the heat exchanger. The sleeve receives the heat exchanger with a friction fit to hold that heat exchanger in position. The heat exchanger can be moved into and out of the sleeve for removal of that heat exchanger from the chimney. Thus, the heat exchanger can be cleaned, serviced, repaired or replaced easily. The heat exchanger has a partition therein which separates the interior thereof into an inlet section and an outlet section. The partition is attached to all the interior surfaces of the heat exchanger, except one. The partition is spaced from that one interior surface to define a gap through which air to be heated must pass to move through the heat exchanger. The heat exchanger has an air inlet port and an air outlet port located near one end thereof, and the gap is located near the other end thereof. Thus, air flowing into the heat exchanger must traverse essentially the entire length of the heat exchanger to move to the outlet side thereof, then again traverse essentially the entire length of the heat exchanger to exit the heat exchanger. Thus, the air to be heated is forced into contact with the heat exchanger heating surfaces for a long time, thereby maximizing the amount of heat which is transferred to that air by those heat exchanger heating surfaces.

Furthermore, the partition is oriented to be at essentially a right angle with respect to the incoming and outgoing flow direction of the air being heated. Due to the gap placement and the orientation of the partition in the heat exchanger with respect to the incoming and outgoing air, the heated air is forced to undergo several changes of flow direction. Such flow direction changes create turbulence in the heated air, thereby increasing the efficiency of heat transfer to that air.

Energy savings of as much as 40% have been realized using this device in place of a heating system without this device.

OBJECTS OF THE INVENTION

It is a main object of the present invention to provide a heat exchanger for use in heating a building which is easily removed for servicing, cleaning and the like.

It is another object of the present invention to provide a heat exchanger for use in heating a building which maximizes the amount of heat transferred to air being heated thereby.

These together with other objects and advantages which will become substantially apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
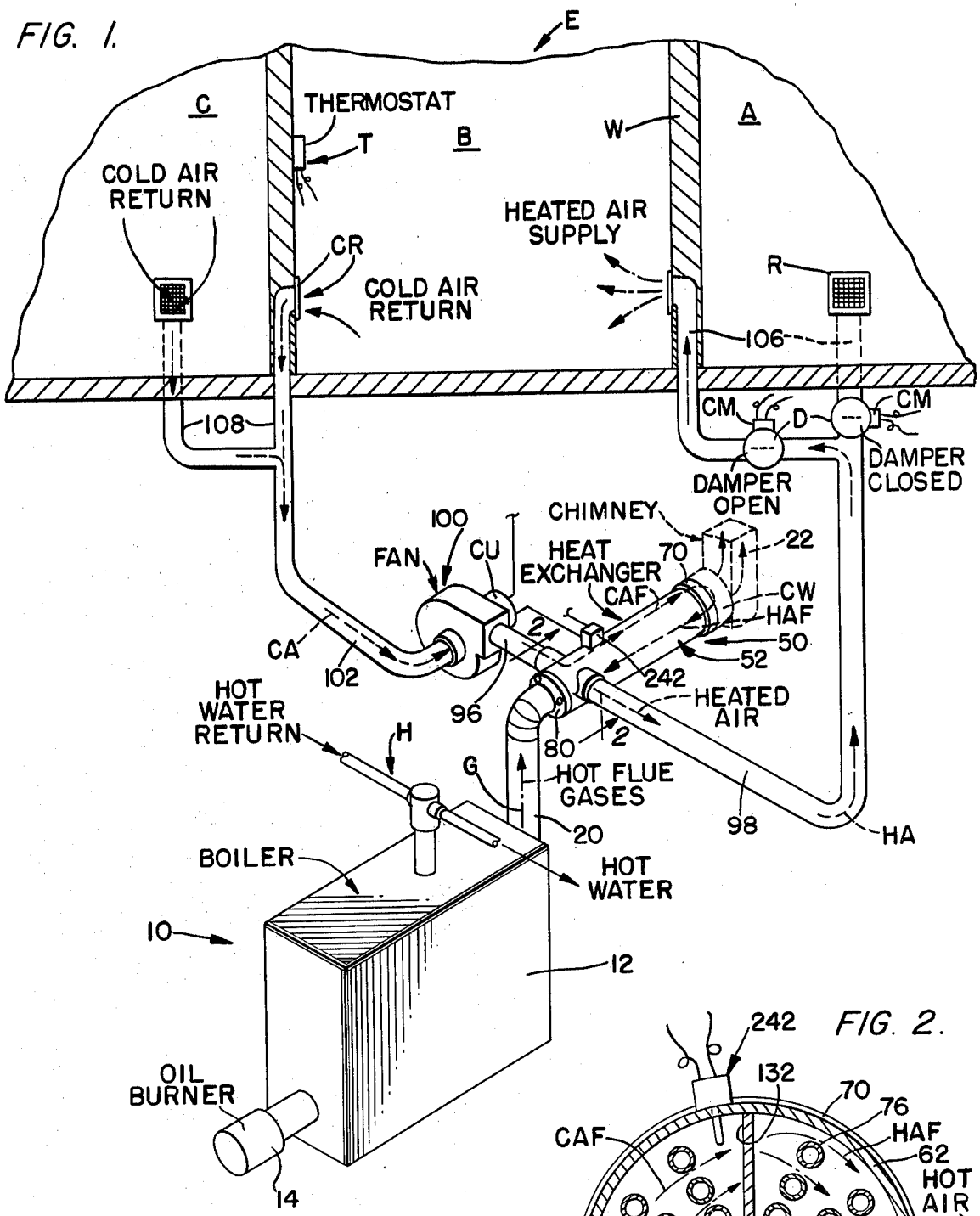
FIG. 1 is a view showing the reheating system embodying the teachings of the present invention.

Shown in FIG. 1 is a setup for recovering heat from a flue. The setup includes an enclosure E which includes a plurality of separate units, such as room A, room B and room C, separated by walls W. Each room includes at least one warm air register R and at least one cold air return register CR. The rooms, or selected ones of the rooms, can also include a thermostat T for regulating the temperature of that room. It is noted that while rooms are disclosed, various areas of a particular enclosure can be used.

As shown in FIG. 1, the setup includes a forced air type furnace 10 which has a boiler unit 12 and an oil burner 14. A hot water heating system H can also be included in the furnace 10. It is here noted that the furnace 10 need not be an oil furnace, but any other type of forced air type furnace can be used without departing from the scope of the present disclosure.

The furnace 10 includes a flue 20 through which hot flue gases are conducted to a chimney 22. Ordinarily, the hot gases are vented directly to the chimney for disposal outside the enclosure. However, as above-discussed, disposal of such hot gases is wasteful, and the present invention is concerned with the use of such hot flue gases to increase the efficiency of the overall heating system efficiency.

The hot flue gases are used in a reheat system 50 which, as best shown in FIG. 1, includes a heat exchanger 52 fluidly interposed between the furnace flue 20 and the chimney 22 so that the flue gases pass through the heat exchanger enroute to the chimney.

Figure 2:
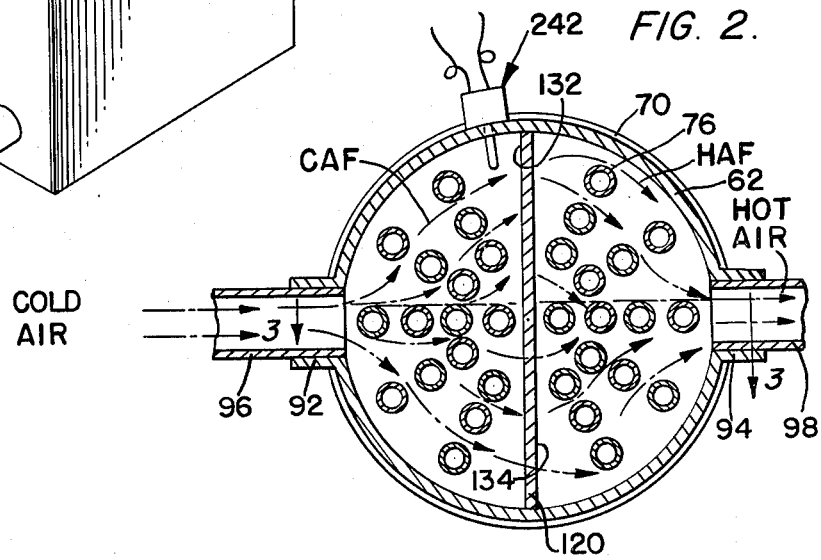
FIG. 2 is a view taken along line 2—2 of FIG. 1.
Figures 3, 4:
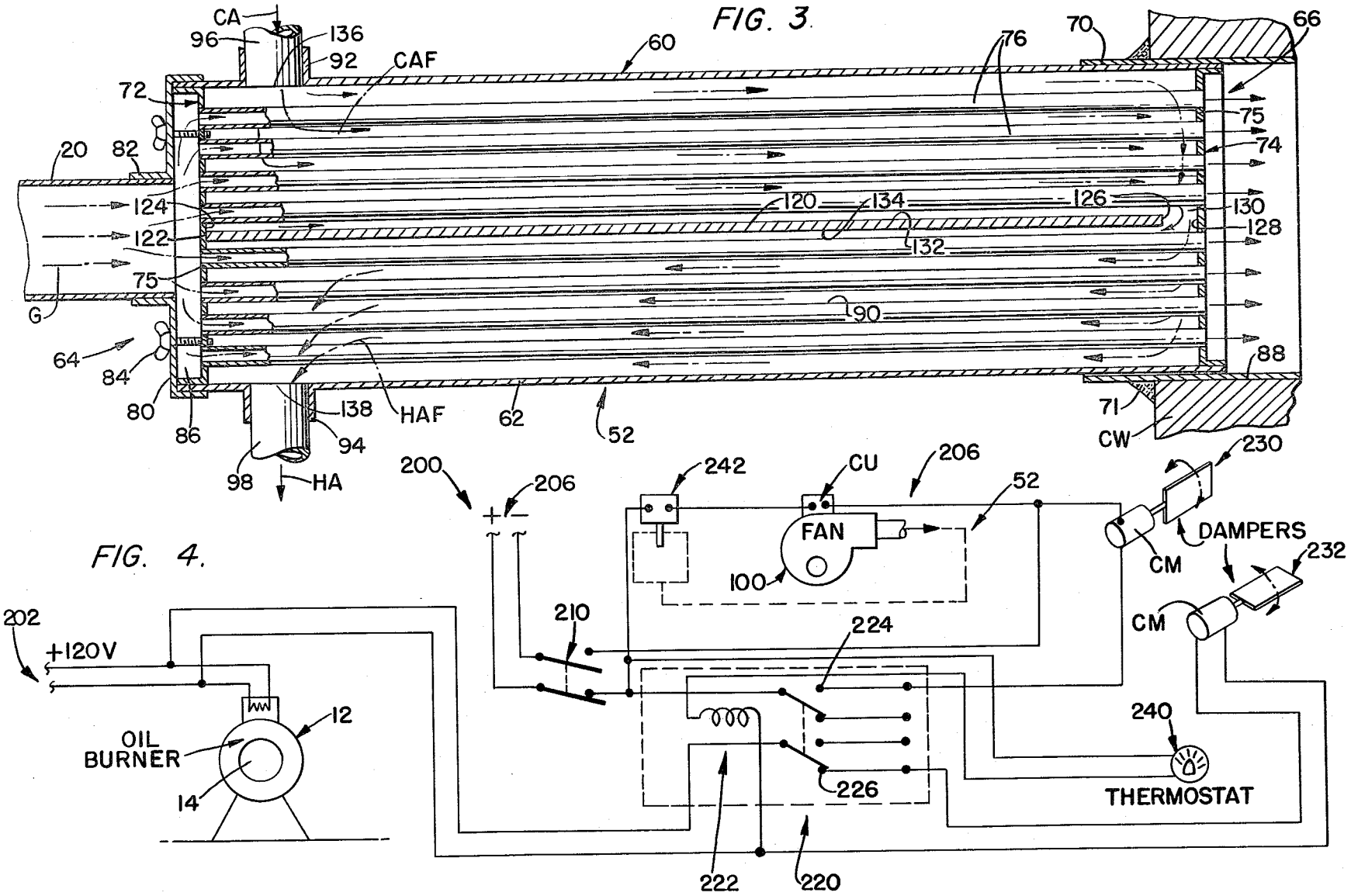
FIG. 3 is a view taken along line 3—3 of FIG. 2.
FIG. 4 is a schematic of a control circuit used in conjunction with the reheating system embodying the teachings of the present invention.

The heat exchanger is best shown in FIGS. 2 and 3 and includes a jacket 60 which is tubular in shape and has a tubular, elongate wall 62. The heat exchanger has a fore end 64 and an aft end 66 with an annular sleeve 70 surrounding the aft end.

The sleeve 70 is preferably permanently affixed to the chimney wall CW as by welding 71, or the like. The heat exchanger jacket is slidably received within the sleeve and is held therein by friction. However, the jacket can be removed from the sleeve if so desired for cleaning of the heat exchanger, servicing thereof, repairing or the like. A new heat exchanger can even be substituted. As above-discussed, the sleeve 70 facilitates such removal and operations.

End caps 72 and 74 are mounted in the end of the heat exchanger and include a plurality of holes 75 for mounting heat exchanger pipe 76 therein. There are a plurality of pipes 76 and these pipes extend axially of the heat exchanger and are end mounted in the end caps to coincide with the holes 75 in the end caps so that fluid communication is established therebetween. A closure cover 80 having an annular collar 82 therein is releasably mounted on the heat exchanger fore end by fasteners, such as wing nuts 84, or the like. A header 86 is defined by the closure cover and fore end cap 72.

As best shown in FIGS. 1 and 3, and as discussed above, the heat exchanger aft end is mounted in a chimney entrance port 88 via the sleeve 70, and the flue 20 is attached to the fore closure cover 80 via the annular collar 82. The annular collar can be friction fit to the flue 20, or clamps or the like can be used. The mounting of the heat exchanger permits easy removal thereof for cleaning or servicing thereof, or even replacement thereof, if necessary. The flue is easily removed from the annular collar 82 for such heat exchanger removal.

As shown in FIGS. 1 and 3, hot flue gases G exiting the furnace 10 flow into the header 86 via the flue pipe 20 and then through the pipes 76 to the chimney 22. The terms "fore" and "aft" are taken with reference to the flow direction of the hot flue gases, and are not intended to be limiting. The outer surfaces 90 of the pipes 76 are heat transfer surfaces and the pipes are heat sources.

The heat exchanger jacket has an inlet collar 92 and an outlet collar 94 thereon. Air duct 96 and hot air delivery duct 98 are fluidly attached to the heat exchanger by these collars. A fan 100 fluidly connects air duct 96 to a cold air return duct 102 to deliver cold return air CA to the heat exchanger and establish a pressure gradient to move the air through the heat exchanger to the hot air delivery duct through which hot air HA moves to the rooms A, B and/or C via duct branches 106 and hot air registers R. Cold return air moves into the cold air duct via the cold air return register CR and branches 108 as best shown in FIG. 1. Dampers D are used in the branches to control the flow, and direction of the air in the warm air ducts. The dampers D can include control means CM connected to a regulator system (not shown in FIG. 1) if so desired. The fan 100 also includes a control unit CU.

As best shown in FIGS. 2 and 3, a partition 120 is mounted in the heat exchanger jacket to extend from the fore end thereof to near the aft end thereof. The partition is planar and has a face end edge 122 abutting inner surface 124 of the fore end cap 72 and an aft end edge 126 spaced from inner surface 128 of the aft end cap 74 to define a gap 130 therebetween. The partition is oriented to have the planar faces 132 and 134 thereof at essentially right angles to the direction of flow of the air CA and HA. The partition is located at or near the longitudinal central axis of the tubular heat exchanger and extends diametrically thereacross. The heat exchanger is thereby divided approximately in half by the partition to define an entrance section and an exit section. The gap 130 thus provides the only fluid communication path from one side of the partition to the other side thereof.

Flow of duct air through the heat exchanger is indicated in FIG. 3 by the arrows CAF and HAF. Thus, cold air is forced from the duct 96 into the heat exchanger via an inlet port 136 and flows along and across the pipes 76 located in the entrance section of the heat exchanger. This cold air is heated by the pipe 76 and contacts the partition to be turned toward the aft end by the heat exchanger, back toward the side wall of the heat exchanger, and generally to be mixed by contact with the pipes, the partition, and the walls in the heat exchanger. The air continues to flow toward the aft end of the heat exchanger due to the continued pressure gradient established by the fan 100, and contacts the aft end cap 74, then turns through gap 130. This air then flows across and along pipe 76 located in the exit side of the heat exchanger or warm air side, and flows toward the fore end via a tortuous path similar to the tortuous path discussed above with regard to the entrance side of the heat exchanger. The air finally exits the heat exchanger via an outlet port 138 and flows into the warm air duct 98.

The partition thus creates turbulence in the air flowing in the heat exchanger and insures good heat transfer contact between the air and the heating pipe 76. Furthermore, the location of the inlet and outlet ports and the gap 130 force the air to remain in contact with the pipes 76 for the maximum time as that air must traverse essentially the entire length of the heat exchanger approximately twice. Such maximized contact time maximizes the amount of heat which is transferred to the air by the pipes 76 during the time that air is in the heat exchanger. Thus, due to the partition, the amount of heat transferred to the air flowing through the heat exchanger is maximized. The linear arrangement of the inlet and outlet collars 92 and 94 at the fore end of the heat exchanger further insures and enhances this maximization.

Shown in FIG. 4 is a control circuit 200 suitable for use in conjunction with the reheat system 50. The furnace 12 is shown schematically as being connected to an existing circuit 202. A new circuit 206 is shown schematically as being connected to the existing circuit. The new circuit includes a first switch 210 and a double pole, double throw switch 220 having a magnetic coil 222 therein. The switch 220 has poles 224 and 226, each associated with dampers 230 and 232, respectively. The dampers 230 and 232 correspond to rooms B and A, respectively, in FIG. 1. The circuit also includes a thermostat 240 and a temperature control unit 242 associated with the heat exchanger 52. As shown in FIG. 4, the thermostat 240 corresponds to thermostat T in Room B of FIG. 1.

Referring to FIG. 4, when the furnace 12 goes on, current flows through the circuit to energize damper 232, and hot gases from the flue 20 flow through the heat exchanger pipes 76 to heat those pipes. The fan 100 is also energized via the control unit CU which is controlled by switch 210. The switch 210 can be activated immediately upon activation of the furnace, or with a slight delay as suitable. The heated air exiting the heat exchanger flows through the duct 98 and the branch 106 into Room A as the damper 232 is open and the damper 230 is closed.

If the temperature in Room B falls below a specified level, thermostat 240 activates switch 220 to disengage the switch from pole 224 and moves that switch into contact with pole 226, thereby closing damper 232 and opening damper 230, and shunting reheated air into Room B. When the temperature in Room B reaches a predetermined level, the thermostat 240 activates switch 220 to move from pole 226 back to pole 224, thereby closing damper 230 and opening damper 232 to shunt air back into Room A. Thus, in the control system shown, the reheated air automatically goes into Room A unless the thermostat 240 in Room B calls for such reheated air. The system is thus set to return to the Room A heating configuration in the absence of other control instructions.

When the furnace shuts down, that is, when the temperature in all the rooms is at or above a desired level, the fan 100 continues to operate until the temperature in the heat exchanger drops to or below a specified level as sensed by the temperature control unit 242. At, or below, this specified level, the fan 100 is shut down, thereby shutting down the system completely. The temperature control unit 242 can also control start up of the fan 100 and only start that fan when the temperature in the heat exchanger 52 reaches, or exceeds, a specified temperature.

Preferably, the reheated air in duct 98 is at least 170° to 180° F., and one embodiment of the present invention has used a boiler firing rate nozzle of about 0.75 per gallon per hour. The heat exchanger of such embodiment has included 30 tubes, with 15 tubes being on the inlet side of the partition 120 and 15 tubes being on the exit side of that partition. The tubes of such embodiment are $\frac{3}{4}$ inch tubes of about 3 to 4 feet in length, and can be copper, steel, or stainless steel. A temperature in the heat exchanger of about 120° has been used as the specified temperature at which the fan 100 is shut down after furnace shutoff.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A flue gas heat recovery system for use in heating a building comprising:

a tubular heat exchanger having a plurality of pipes therein fluidly connected to a flue pipe of a furnace to receive hot gas therefrom, said pipes being fluidly connected to a chimney for dispensing such hot gas thereto, said heat exchanger having an inlet means located near one end thereof for receiving air to be heated by said heat exchanger, and an outlet means located near said heat exchanger one end for fluidly connecting said heat exchanger to an air exhaust duct;

an annular sleeve permanently affixed to a chimney and telescopingly and releasably receiving one end of said tubular heat exchanger so that said heat exchanger can be removed from such chimney;

a planar partition located within said heat exchanger and extending from said heat exchanger one end to adjacent another end of said heat exchanger, said partition having one edge thereof spaced from said heat exchanger another end to define a gap and being in contact with said heat exchanger at all other edges thereof so that fluid communication across said partition is established only via said gap, said partition being oriented to be at essentially a right angle with respect to the flow direction of air flowing through said inlet and outlet means, said partition creating turbulence in air to be heated by said heat exchanger as such air flows through said heat exchanger and causing such air to traverse essentially the entire length of said heat exchanger approximately twice in flowing from said inlet means to said outlet means;

air moving means connected to said inlet means for moving air to be heated into said heat exchanger;

a plurality of dampers, each damper controlling air flow in an individual room of a plurality of rooms in a building, one room of said plurality of rooms being a preferred room;

air conduits connecting the furnace to each of said rooms; and a control circuit connected to the furnace and to said dampers, said control circuit including a thermostat in each room other than said preferred room, switch means connected to said dampers and to said thermostats, said switch means having one position associated with each damper connecting a power source to said each damper to activate that damper to permit air to flow from an air conduit associated therewith into a room associated therewith, and control means causing said switch means to move into said one position in response to a signal from a thermostat associated with a room, said control means maintaining said switch means in an orientation which permits air flow from the furnace to said preferred room unless a signal from a thermostat is received by said control means so that air from the furnace is normally directed to said preferred room unless the temperature in one of the other rooms drops to a level which causes actuation of a thermostat in said one room at which time air from the furnace is directed to said one room until the temperature in that room rises to a level which causes the thermostat in that one room to signal said switch means so that air from the furnace is returned to said preferred room.

2. The flue gas heat recovery system defined in claim 1 wherein said air moving means includes a fan.

3. The flue gas heat recovery system defined in claim 1 further including control means on said air moving means for controlling operation of said air moving means according to the temperature in said heat exchanger.

4. The flue gas heat recovery system defined in claim 1 wherein said inlet and outlet means are aligned with each other.

5. The flue gas heat recovery system defined in claim 3 further including a control system for controlling operation of said air moving means and for directing air from said air exhaust duct to various locations within a building.

6. The flue gas heat recovery system defined in claim 5 wherein said control system includes regulator means for directing air from said exhaust duct to a specific location except when instructed otherwise.

7. The flue gas heat recovery system defined in claim 6 wherein said regulator means includes a thermostat located at another location.

8. The flue gas heat recovery system defined in claim 7 wherein said control means further includes dampers fluidly connected to said exhaust air duct.

* * * * *